United States Patent [19]

Rousseau et al.

[11] 4,112,851

[45] Sep. 12, 1978

[54] RESILIENT CONSTANT CONTACT CENTER BEARING ASSEMBLY

[75] Inventors: George L. Rousseau, Munster; Richard C. Snyder, Michigan City, both of Ind.

[73] Assignee: Pullman Incorporated, Chicago, Ill.

[21] Appl. No.: 765,504

[22] Filed: Feb. 25, 1977

[51] Int. Cl.[2] ..... B61F 1/14; B61F 5/14; B61F 5/20; F16C 17/04

[52] U.S. Cl. ..... 105/199 C; 105/199 CB; 308/137

[58] Field of Search ..... 105/197 A, 199 C, 199 CB, 105/4 R, 131, 159, 175 R, 197 R, 201, 368 S; 308/137; 24/317; 310/13

[56] References Cited

U.S. PATENT DOCUMENTS

| | | | |
|---|---|---|---|
| 663,520 | 12/1900 | Shipman | 24/217 |
| 1,099,949 | 6/1914 | Thomas | 105/197 R |
| 1,116,103 | 11/1914 | Nichols | 105/201 |
| 1,219,647 | 3/1917 | Lake | 105/159 |
| 1,555,288 | 9/1925 | Jablow et al. | 105/199 C |
| 2,058,630 | 10/1936 | Rice | 105/131 |
| 2,065,573 | 12/1936 | Frede | 105/159 |
| 2,067,483 | 1/1937 | Ferris | 105/175 R |
| 2,150,896 | 3/1939 | Muchnic | 105/199 C |
| 3,082,702 | 3/1963 | Mohr, Jr. | 105/199 C X |
| 3,218,489 | 11/1965 | Sadler | 310/13 |
| 3,257,969 | 6/1966 | Thomas | 105/199 C |
| 3,396,673 | 8/1968 | Livelsberger et al. | 105/4 R |
| 3,405,654 | 10/1968 | Dilg | 308/137 X |
| 3,549,217 | 12/1970 | Watson | 105/199 C |
| 3,602,469 | 8/1971 | Hammonds | 105/368 S |
| 3,667,820 | 6/1972 | Sherrick | 308/137 |
| 3,709,151 | 1/1973 | Cook et al. | 308/137 X |
| 3,831,530 | 8/1974 | Cope | 105/199 C |
| 3,847,090 | 11/1974 | Love et al. | 105/199 C |

FOREIGN PATENT DOCUMENTS

| | | | |
|---|---|---|---|
| 566,697 | 12/1932 | Fed. Rep. of Germany | 105/197 A |
| 1,188,642 | 3/1965 | Fed. Rep. of Germany | 105/199 C |
| 1,293,807 | 4/1969 | Fed. Rep. of Germany | 105/199 C |

*Primary Examiner*—Drayton E. Hoffman
*Assistant Examiner*—Howard Beltran
*Attorney, Agent, or Firm*—Thomas G. Anderson

[57] ABSTRACT

The present invention relates to a load equalizing and vibration damping center bearing assembly for a railway vehicle. The center bearing assembly includes a flat body center plate depending from the car body, a bowl having a downwardly concave curved inner surface supported on the wheel truck, a tiltable insert disposed in the bowl having a flat upper surface mating with the body center plate and a curved lower surface contiguous to the inner surface of the bowl, and a resilient liner interposed between the insert and the bowl which absorbs vehicle vibration and assures constant and uniform bearing support through said bearing assembly between the vehicle body and the associated wheel truck.

6 Claims, 3 Drawing Figures

RESILIENT CONSTANT CONTACT CENTER BEARING ASSEMBLY

BACKGROUND OF THE INVENTION

1. Field of the Invention

The present invention relates to the underframe of a railway car and more particularly to an improved center bearing assembly interposed between the underframe and the trucks.

2. Description of the Prior Art

The prior art is exemplified by U.S. Pat. Nos. 3,082,702; 3,709,151 and 3,847,090 which show railway center bearing assemblies having a spherical or conical interface between their respective bearing elements. Attention is also directed to U.S. Pat. No. 3,405,654 which shows a resilient railway center plate design.

SUMMARY OF THE INVENTION

The present invention relates to a load equalizing and vibration damping center bearing assembly for a railway vehicle including a car body bolster and a supporting wheel truck having a transverse truck bolster. The center bearing assembly includes a bowl supported on the truck bolster having a downwardly concave curved inner surface, a tiltable insert disposed in the bowl having a flat upper surface and a curved lower surface contiguous to the inner surface of the bowl, a resilient liner interposed between the insert and the bowl, and a flat body center plate adapted to support the car bolster matingly on the flat upper surface of the insert.

DESCRIPTION OF THE PREFERRED EMBODIMENT

Figure 1:
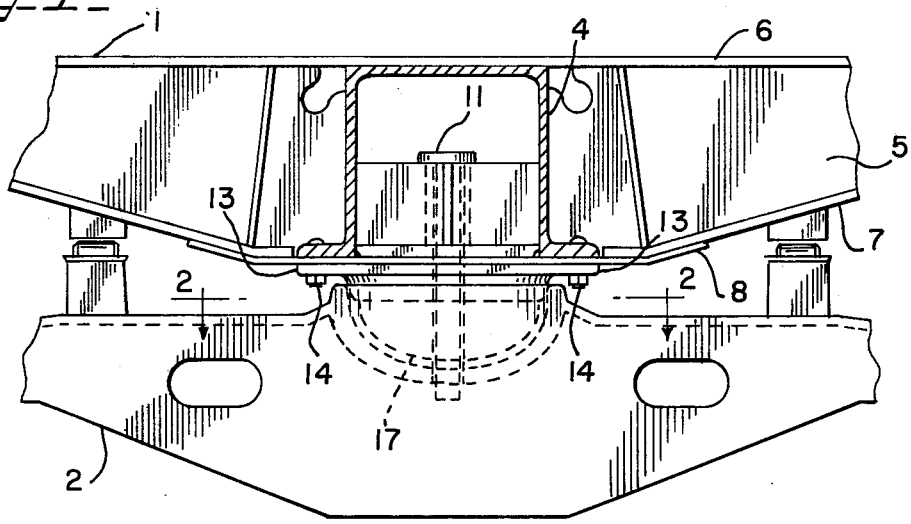
FIG. 1 is an end view of a railway car underframe having the center bearing assembly in accordance with and embodying the present invention.

Referring to the drawings and particularly FIG. 1, there shown is a car body bolster 1 pivotally supported on a truck bolster 2 through the center bearing assembly 3 of the present invention. As thus positioned, the center bearing assembly receives and transfers vertically directed loads from the car body to the car truck as well as lateral and longitudinal forces resulting from the rocking of the car due to truck hunting, etc. during rail use of the car.

The general vehicle construction provides that the car body include a longitudinally extending center sill 4 hat-shaped in cross section and a transversely extending car body bolster beam 1 above each truck. Each body bolster beam 1 is of a rectangular closed beam construction and includes vertically extending bolster webs 5, upper and lower connecting cover plates 6 and 7, and stress or wear plate 8. Each truck includes a truck bolster beam 2 which extends transversely of the vehicle and is vertically spaced beneath an associated body bolster beam 1. The outer ends of the truck bolsters 2 are supported on respective truck side frames (not shown) which in turn are mounted on the car wheel axles.

Figure 2:
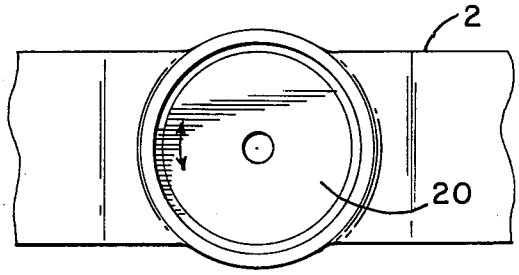
FIG. 2 is a fragmentary section taken generally along line 2—2 in FIG. 1.

The center bearing assembly 3 contemplated by the present invention includes car body center plate 9, a center plate bowl assembly 10, and a conventional center pin 11 extending vertically therethrough. As can be seen from FIG. 2, the center pin 11 is loosely carried to accommodate dynamic tilting of the car body bolster 1 relative to the truck bolster beam 2 yet is sufficiently constrained to assist in assuring the load distributing character of the pivotal connection between the supporting wheel truck and the car body. The car body center plate 9 includes a disc-shaped flat plate portion 12 mated with and bearingly supported by the center plate bowl assembly 10 and a peripheral flange portion 13 which is secured by bolts 14 to firmly hold the flat plate portion 12 in position on the underside of the stress or wear plate 8.

Figure 3:
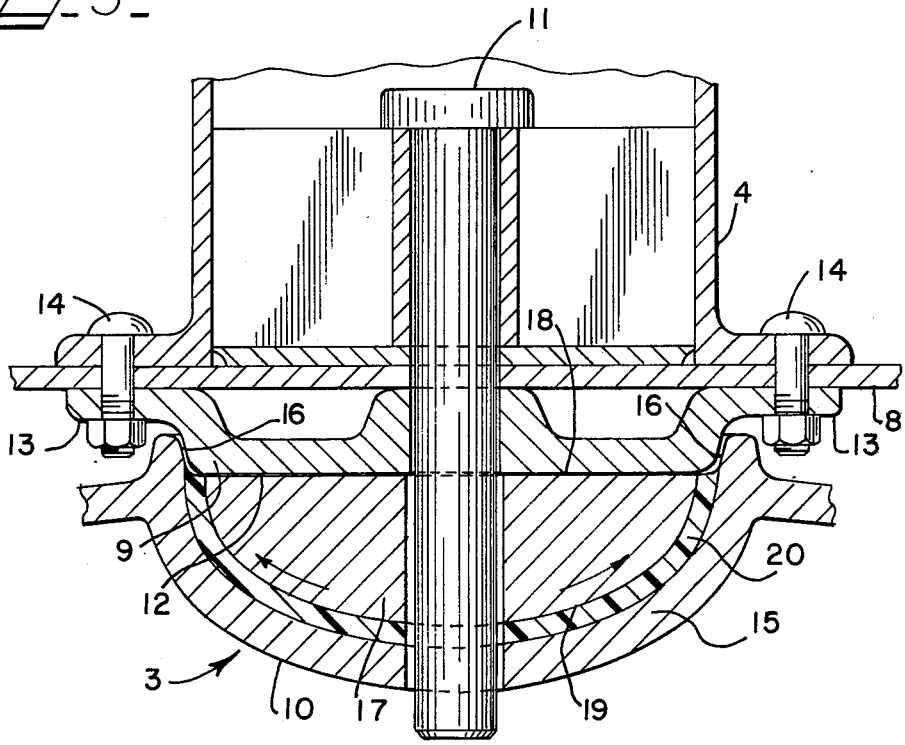
FIG. 3 is an enlarged cross-sectional view taken substantially through the vertical axis of the center bearing assembly.

The center plate bowl assembly 10 includes a downwardly concave bowl portion 15 in the truck bolster which is generally semi-ovoidally shaped while being generally semi-elliptical in vertical cross section and which includes a circumferal upwardly extending side portion or rim 16 about its periphery. Carried within the bowl portion 15 is a rigid bearing insert 17 having a flat upper surface 18 mating with the center plate 9 and a lower curved surface 19 generally corresponding to the inner semi-ovoidal contour of the bowl portion 15. The insert 17 is carried by the bowl 15 through a slightly resilient vibration damping liner 20 (e.g., a polymeric material) interposed between the bowl 15 and the liner 20 substantially as shown in FIG. 3. The liner 20 may be bonded to the insert 17 to prevent it from sliding sideways within the bowl; or, alternatively, the liner may be bonded to both the insert 17 and the bowl portion in which event the slightly resilient liner 20 also damps rocking oscillatory movement of the insert 17 within the bowl portion and further assures that the center plate bowl assembly 10 and the car body center plate 9 remain in constant bearing contact during severe rocking motion of the car body on the trucks.

From the above, it can be seen that the semi-elliptic curved bearing interface between the bowl portion 15 and the insert 17 provides a means of uniformly dumping car loads through the body center plate and bowl assembly to essentially eliminate the development of extreme stress concentrations leading to bearing fracture as well as reducing vibrations therebetween contributing to instability and reduced roadability of the car. Additionally, since the truck bowl assembly 10 is mounted vertically within the truck bolster 2 and can be used with conventional car body center plates such as that shown, the invention can be installed and used without any modification of the car body underframe structure which otherwise would be required to attain proper vertical clearance of the car body structure established by AAR guidelines (e.g., coupler height, etc.).

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A vibration damping center bearing assembly for a railway vehicle including a car body bolster and a supporting wheel truck having a transverse truck bolster including upper horizontal plate portions extending between its ends, a bowl supported on said truck bolster having a peripheral rim flange extending upwardly beyond said plate portions and a downwardly concave curved inner surface generally semi-ovoidally shaped, a shiftable insert disposed in said bowl having a generally semi-ovoidal lower surface contiguous to the inner surface of the bowl in radial and vertical load supporting relation thereto and a flat upper surface within a bowl and substantially in the horizontal plane defined by said upper plates portions, a complementary resilient liner interposed between said lower and inner surfaces and bonded to one of said surfaces, and a center plate adapted to support said body bolster having a flat lower surface mating with the flat upper surface of said insert and supported thereon for relative rotative movement therebetween.

2. The invention according to claim 1, and said liner being a polymeric material.

3. The invention according to claim 1, and said liner being bonded to said insert.

4. The invention according to claim 1, and said center plate including a cylindrical plate portion having flange portions extending outwardly therefrom, and attachment means coupling said flange portions to the body bolster.

5. The invention according to claim 1, and center pin means coupling said bowl, insert and center plate to the body bolster.

6. The invention according to claim 1, and said body bolster being generally rectangular in cross section and including spaced vertical web portions and upper and lower cover plates coupling said webs.

* * * * *